United States Patent [19]

Angevine et al.

[11] 4,447,312

[45] May 8, 1984

[54] PROCESS FOR IMPROVING THE DIESEL FUEL QUALITY OF COAL DERIVED LIQUIDS

[75] Inventors: Philip J. Angevine, West Deptford; Costandi A. Audeh, Princeton; Samuel A. Tabak, Wenonah, all of N.J.; Tsoung Y. Yan, Philadelphia, Pa.

[73] Assignee: Mobil Oil Corporation, New York, N.Y.

[21] Appl. No.: 340,662

[22] Filed: Jan. 19, 1982

[51] Int. Cl.[3] ..... C10G 11/05

[52] U.S. Cl. ..... 208/46; 208/8 LE; 208/133; 208/134; 208/141; 585/721; 585/942

[58] Field of Search ..... 208/46, 15, 8 LE, 8 R, 208/133, 134, 141; 585/446, 467, 721, 510, 943

[56] References Cited

U.S. PATENT DOCUMENTS

| | | | |
|---|---|---|---|
| 3,326,866 | 6/1967 | Haag | 585/510 |
| 3,928,171 | 12/1975 | Yan et al. | 208/46 |
| 4,096,163 | 6/1978 | Chang et al. | 585/943 |
| 4,105,535 | 8/1978 | Peters | 208/8 R |
| 4,153,540 | 5/1979 | Gorring et al. | 208/216 R |
| 4,181,597 | 1/1980 | Yan et al. | 208/46 |
| 4,304,951 | 12/1981 | Garwood et al. | 585/469 |

FOREIGN PATENT DOCUMENTS 2060681 5/1981 United Kingdom .

*Primary Examiner*—Delbert E. Gantz
*Assistant Examiner*—A. Pal
*Attorney, Agent, or Firm*—Alexander J. McKillop; Michael G. Gilman

[57] ABSTRACT

A process for preparing diesel fuel from coal-derived light fuel oils by alkylating said coal-derived light fuel oils with olefins and hydrotreating said alkylated product.

28 Claims, 3 Drawing Figures

PROCESS FOR IMPROVING THE DIESEL FUEL QUALITY OF COAL DERIVED LIQUIDS

BACKGROUND OF THE INVENTION

This invention relates to a process for improving the quality of coal-derived liquids and more particularly to a process for improving the diesel fuel quality of coal-derived liquids.

The supply of domestic petroleum stocks, in comparison with demand, has been declining over the years. The need for a supplemental source of liquid hydrocarbon fuels is becoming clearly apparent. Domestic coal deposits appear to provide one such source for such hydrocarbon fuels.

Coal derived liquids are those liquids derived from coal by a variety of processes, including hydrogenation, H-donor solvent reactions, destructive distillation, pyrolysis in the presence or absence of hydrogen and extraction in various solvents.

The production of gasoline from coal-derived liquids is well known in the art. In fact, current process schemes, in the liquefaction of coal, emphasize gasoline as the major liquid product. U.S. Pat. Nos. 3,018,241, 3,018,242, 3,117,921, 3,143,489, and 3,700,586 are representative of such processes.

Recently, in addition to gasoline, there has been high demand for diesel fuel. However, because an acceptable cetane number distillate is difficult to achieve without very high hydrogen costs, the production of acceptable fuels from coal-derived liquids has not been, until the present invention, a feasible alternate route to diesel fuel production.

SUMMARY OF THE INVENTION

Accordingly, it is one object of the present invention to provide a process for the production of diesel fuel from coal-derived liquids.

Another object of this invention is to provide a process for the production of diesel fuel having improved cetane numbers.

Still another object of this invention is to provide a process for the production of diesel fuel from coal-derived liquids which avoids the costly hydrogenation required in the past to achieve acceptable cetane numbers.

These and other objects are accomplished herein by a process which comprises the steps of:

(i) contacting a coal-derived light fuel oil cut liquid, having a low cetane index, with an olefin, having at least three carbon atoms, under alkylation reaction conditions; and (ii) optionally, hydrogenating the alkylated product from step (i).

In another variation of the invention herein, the process comprises the steps of:

(i) hydrogenating a coal-derived light fuel oil cut having a low cetane index and (ii) contacting the hydrogenated coal-derived liquid from step (i) with an olefin, having at least three carbon atoms, under alkylation reaction conditions.

DETAILED DESCRIPTION OF THE INVENTION

Figure 1:
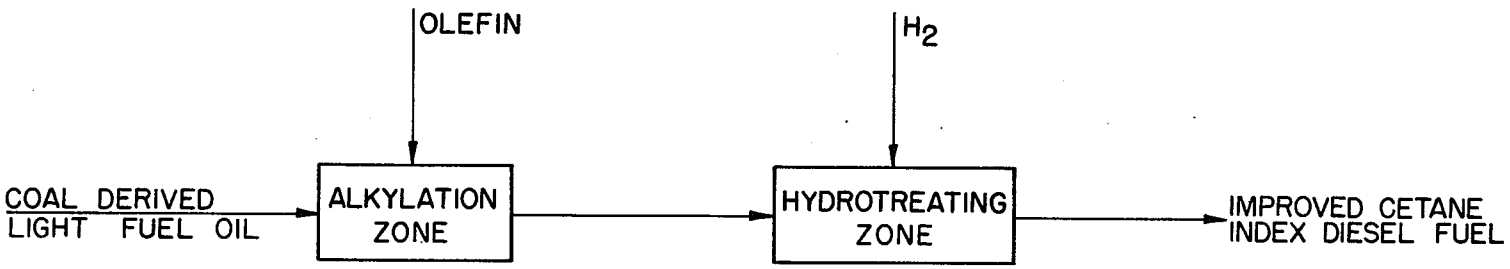
FIG. 1 is a flow diagram of one manner in which the present process may be carried out.

Coal liquids are those liquids derived from coal by a variety of processes, including hydrogenation, H-donor solvent reactions, destructive distillation, pyrolysis in the presence and absence of hydrogen and extraction in various solvents. The process of the present invention may be advantageously employed with any coal-derived liquid, regardless of the manner of derivation.

Thus, in accordance with the present invention coal-derived light fuel oil liquids (boiling point in the range of from about 380° F. to about 700° F.), low in cetane number, (e.g. about 7–10) may be upgraded to acceptable diesel fuel levels (e.g. cetane index of about 30–70) by severl schemes. In one scheme illustrated by FIG. 1, liquefied coal, i.e. coal-derived light fuel oil liquid, is introduced to an alkylation zone wherein said coal-derived liquid is contacted with an alkylating agent under alkylation conditions.

Alkylating agents, which are encompassed within the scope of the present invention include, for example, olefins having at least three carbon atoms. Thus, alkylating agents included herein and olefins having the structure $$-\overset{|}{C}=\overset{|}{C}-$$

in which the open valences are satisfied by hydrogen, or radicals such as alkyl, aryl, aralkyl, alkaryl or other alkenyl, said radicals containing, for example, from 1 to 30 carbon atoms. Typically, olefins falling within this definition include ethylene, propylene, butene, hexene, heptene, decene, octadecene, butadiene, styrene, phenyl propylene, propylene polymers, such as propylene tetramer, $C_3$ to $C_9$ olefins, or a mixture of olefins and alkanes, such as propylene/propane or butene/butane, or any other convenient mixture, e.g. olefins in a reaction product mixture from a dehydrogenation reaction, catalytic cracking (such as FCC and TCC), thermal cracking and coking, Fischer-Tropsch process and coal pyrolysis.

In general, the alkylation herein of the coal-derived light fuel oil, using the foregoing described olefins, is carried out in the presence of a suitable alkylation catalyst. Alkylation catalysts contemplated herein generally include acidic, or acid-acting catalysts. Thus, the classes of suitable catalysts include acid resins, clays, amorphous or crystalline (i.e. zeolitic) aluminoslicates, and other acidic oxides. These solid catalysts, which are useful in fluid and fixed bed catalysts, being heterogenous to the reactants, are readily separable therefrom.

Of particular interest as alkylation catalysts herein are the resins, clays and zeolites. The resins, preferably cation-exchanged resins, consist of a polymeric resin matrix having an acidic functional group, such as sulfonic, phosphonic, phenyl sulfonic, phenylphosphonic, phenolsulfonic, and the like. The matrix may be any resin, which is preferably porous, either initially or becoming so during the process, including specifically phenolic resin, polystyrene, copolymers of styrene with polyfunctional polymerizable monomers or partial polymers, such as styrene-divinylaryls, e.g., divinyl benzene or acrylates, polyacrylic or polymethacrylic acid resins, and halogenated variations of these above said resins. Sulfonated coal also provides an acid acting catalyst. Acidic clays, such as attapulgite and montmorillonite are also among the preferred catalysts. Crystalline aluminosilicates, at least partially in the hydrogen form, are also very good catalysts. They generally have the formula $$M_{2/n}O.Al_2O_3.ySiO_2.zH_2O$$

where M is a cation, n is its valence, y is the moles of silica, and z is the moles of water. Crystalline zeolites are well-known (U.S. Pat. Nos. 3,140,249 and 3,140,253). Modified zeolites, such as rare earth-exchanges or other metal exchanged zeolites may be used. Rare earth-exchanged Y-types (y is over 3) and X-types (y is under 3) are examples of these. Both natural aluminosilicates, such as levynite, faujasite, analcite, noselite, phillipsite, datolite, chabazite, leucite, mordenite, and the like, and synthetic aluminosilicates are examples of satisfactory catalysts. Other catalysts which may be used in this invention include inorganic oxides such as alumina, silica alumina mixture, thoria, vanadia, zirconia, titania, chromia, chromia-alumina, molybdena, germania, ceria, halogenated alumina, molybdena-alumina and mixtures thereof and these with any of the other foregoing classes of catalysts.

Those skilled in the art of heterogeneous catalysts recognize that there are many insoluble solids with a porous structure that are effective in inducing acid-catalyzed reactions, and that, because of this property, are referred to as "acidic". It is also recognized that these heterogeneous, acidic catalysts vary in efficacy, depending on catalyst preparation in some cases, and on other factors such as the particular reactions involved. These heterogeneous acidic catalysts may be organic, such as sulfonated polystyrene, or inorganic, such as silica-alumina cracking catalyst. The inorganic acidic catalysts exemplified in the foregoing paragraphs and elsewhere are simple or mixed inorganic oxides, which may be polymeric or hydrated to varying extent, as will be recognized by one skilled in the art. With few exceptions, the heterogeneous inorganic acidic oxide catalysts useful in this invention comprise an oxide selected from the group consisting of silicon and aluminum. Included in this group are the acidic clays, the acidic forms of crystalline aluminosilicate zeolites, and the known acidic cracking catalysts based on mixed oxides such as silica-alumina, silica-magnesia and silica-zirconia. Since not all inorganic oxides are "acidic", i.e. function to catalyze acid-catalyzed reactions, it is useful to provide an independent means for determining if a solid does function as a heterogeneous, acidic catalyst and to what extent it possesses this property.

An independent means of describing the catalysts useful in this invention is by their ability to affect the alkylation of benzene with propylene to form cumene, which is recognized by those skilled in the art of catalysis to be an acid-catalyzed reaction. In this independent reaction 100 grams of benzene is reacted with excess propylene in the presence of 5 grams of a desired catalyst, at a temperature of from about 78° to about 80° C. Analysis by gas chromatography was used to track the reaction over a 5-day period. It has been found that catalysts having an activity rate of at least preferably about $0.003\times10^{-2}$ grams of cumene per gram of catalyst per hour (from 100 grams of benzene) provide satisfactory catalysts. Although less active catalysts are acceptable, they are less preferred for the purpose of this invention. It should be noted that without any catalyst, the reaction produces no detectable amount of cumene.

In carrying out the process of this invention, the coal-derived light fuel oil may be mixed with the alkylating agent and catalyst, or the alkylating agent and catalyst, or the alkylating agent and coal-derived liquid feed may be premixed and then mixed with the catalyst. If a continuous operation is desired, the reactants, for example may be passed over a fixed bed reactor which contains the catalyst.

The alkylation reaction, i.e. catalyst contact, is generally carried out at between about 25° to about 350° C. and most preferably from 90° C. to 280° C., at pressures of from atmospheric to about 700 psig for a time of from about 0.1 hours to about 10 hours, preferably from about 0.5 to about 2 hours. Moreover, generally sufficient alkylation to result in a diesel fuel product having a cetane index of from about 30 to about 70 is employed herein.

After alkylation, the alkylated coal-derived liquid is generally recovered by stripping off unreacted olefin, or any remaining spent compounds or by-product and recovering the alkylated reaction product. If a fluid-bed or intermixed catalyst system is used as in batch-type reactions, the catalyst must be filtered out; filtration is, of course, unnecessary in fixed bed or fluid bed continuous operations.

In furtherance of the process herein, as also illustrated in FIG. 1, the alkylation product may be optionally fed to a hydrotreating zone wherein the alkylation product is subjected to and, further upgraded by high pressure catalytic hydrogenation. Typically, conditions for hydrotreating include contacting the alkylated liquid with hydrogen gas at temperatures in the range of from about 350° to about 425° C., pressures of from about 50 to about 250 atm., preferably from about 100 to about 200 atm. with a liquid hourly space velocity ranging from about 0.1 to about 2.0, preferably from about 0.2 to about 0.7. The hydrotreating is also generally carried out in the presence of a suitable hydrogenation catalyst. Typically these include, for example, $CoO-MoO_3/Al_2O_3$, $NiO-MoO_3/Al_2O_3$, $NiO-WO_3/Al_2O_3$, and the like.

Figure 2:
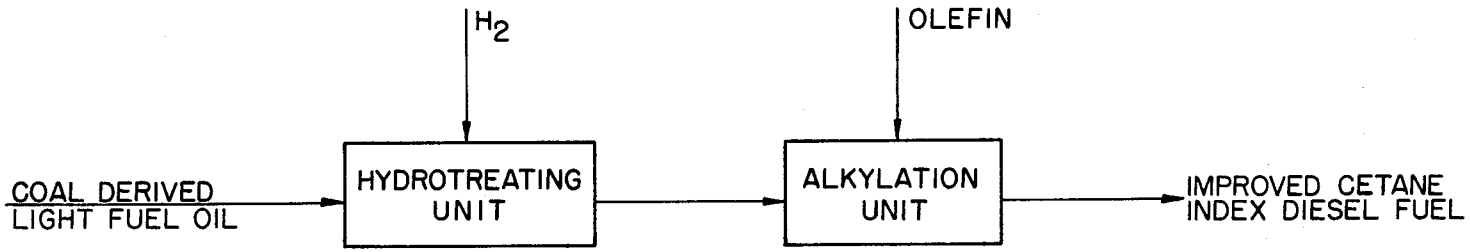
FIG. 2 is a flow diagram of another manner in which the present process may be performed to upgrade the quality of coal-derived liquids.
Figure 3:
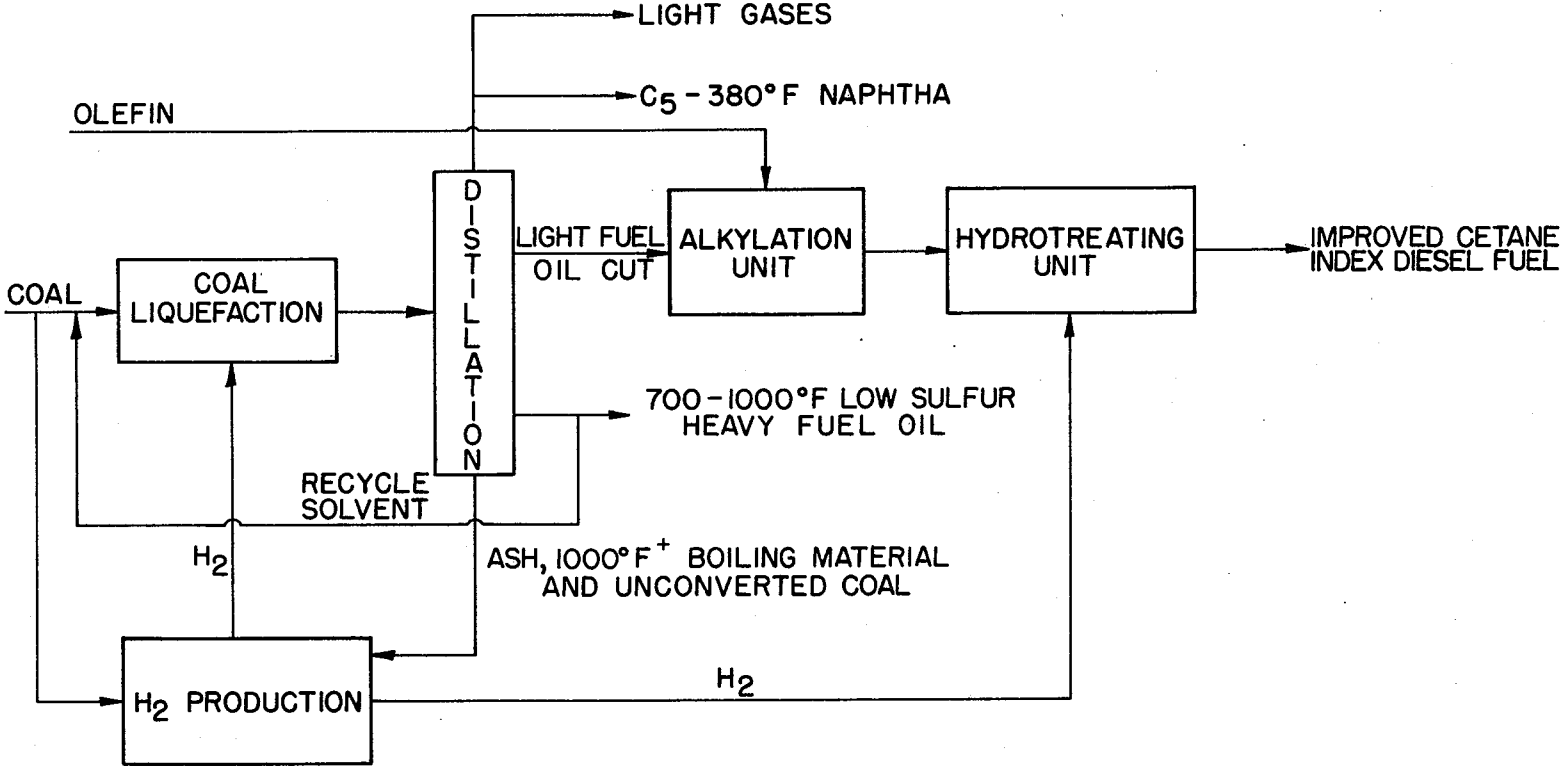
FIG. 3 is a flow diagram of an embodiment of the present invention illustrating the incorporation of a coal liquefaction step.

As indicated hereinbefore, the process of the present invention can also be performed by first hydrotreating the coal-derived light fuel oil cut and then subjecting the hydrotreated material to alkylation as hereinbefore described. This scheme is illustrated in FIG. 2. Moreover, as indicated hereinbefore, an initial coal liquefaction step may be incorporated into the present process as illustrated by FIG. 3. In this scheme, a portion of the coal can be used for hydrogen production which in turn can be utilized in the coal liquefaction and in the hydrotreating step of the process.

In order that those skilled in the art may better understand how the present invention may be practiced, the following examples are given by way of illustration and not by way of limitation.

EXAMPLE I

An Illinois No. 6 bituminous coal was liquefied to a syncrude via the H-Coal process. The 380°–700° F. fraction (Table 1) is then hydrotreated to a low nitrogen stock (Table 2). The hydrotreatment is carried out at 700° F., 2000 psig, 0.25 LHSV, 8000 standard cubic feet $H_2$ circulation per barrel in the presence of a Ni/tungsten/$Al_2O_3$ catalyst. The remaining 380° F.+ fraction, although hydrogenated to less than 15% aromatics, still has only a 31.5 cetane index. The hydrotreated 380° F.+ fraction is then alkylated with 1-heptene over an activated acid resin in a stirred flask at 125° C. and atmospheric pressure for 24 hours; essentially 95% of the reaction occurs during the first hour. The quantities used are 2.5 g/27 g/177 g resin/1-heptene/coal liquid. Following the reaction, the unreacted 1-heptene is removed by distillation and found to be approximately 50% of the initial 1-heptene. The alkylated coal liquid has an °API gravity of 30.5, a mid-boiling point of 483° F., and a cetane index of 35.5. The improvement in cetane index of 4.0 is achieved with only a slight increase in the overall liquid hydrogen content.

| | H, Wt % |
|---|---|
| H-Coal 380° F.+ | 13.08 |
| 1-Heptene | 14.29 |
| Alkylated product | 13.17 |

The hydrogen content of the alkylated product here is calculated assuming 50% of the 1-heptene has been reacted.

TABLE 1

| Properties of H-Coal 380–700° F. | |
|---|---|
| Gravity, °API | 14.1 |
| H, wt % | 9.43 |
| S, wt % | 0.137 |
| N, wt % | 0.62 |
| O, wt % | 1.76 |
| Calc. cetane Index | 7.6 |
| Distillation, °F., (D2887) | |
| IBP | 390 |
| 5% | 403 |
| 10 | 412 |
| 30 | 443 |
| 50 | 494 |
| 70 | 534 |
| 90 | 588 |
| 95 | 617 |
| EP | 704 |
| Paraffins, wt % | 3.9 |
| Naphthenes, wt % | 7.1 |
| Aromatics, wt % | 89.0 |

TABLE 2

| Properties of Hydrotreated H-Coal Syncrude | IBP-380° F. | 380° F.+ |
|---|---|---|
| Yield, wt % | 13.2 | 86.8 |
| Properties | | |
| Gravity, ÅPI | 43.8 | 28.8 |
| H, wt % | 14.01 | 13.08 |
| S, ppm | <10 | 70 |
| N, ppm | <1 | 3.5 |
| RON + O | 48 | — |
| Calc. Cetane Index | — | 31.5 |
| Paraffins, vol % | 4.2 | 6.5 |
| Naphthenes, vol % | 92.0 | 78.8 |
| Aromatics, vol % | 3.8 | 14.7 |
| Distillation, °F. (D2887) | | |
| IBP | 147 | 322 |
| 5 | 205 | 372 |
| 10 | 209 | 385 |
| 30 | 264 | 436 |
| 50 | 304 | 474 |
| 70 | 332 | 505 |
| 90 | 368 | 558 |
| 95 | 379 | 576 |

TABLE 2-continued

| Properties of Hydrotreated H-Coal Syncrude | IBP-380° F. | 380° F.+ |
|---|---|---|
| EP | 397 | 618 |

In addition to the resin used in this Example 1, other lower acidity catalysts can be used as the alkylation catalyst as well as other olefins as the alkylating reagent.

Moreover, in lieu of the syncrude utilized in Example 1, other coal-derived light fuel oil cuts or distillates, for example, raw or mildly hydrotreated H-coal liquids, may be employed in the present process with equal or better results.

Obviously, other modifications and variations of the present invention are possible in the light of the above teachings. It is, therefore, to be understood that changes may be made in the particular embodiments of this invention which are within the full intended scope of the invention or defined by the appended claims.

What is claimed is:

1. A process for improving the quality of light fuel oil derived by the direct liquefaction of coal having a low cetane number, said process comprising the steps of:

(i) contacting said light fuel oil liquid with an olefin having at least three carbon atoms under alkylation conditions.

2. The process as defined in claim 1 wherein step (i) is carried out in the presence of an alkylation catalyst.

3. The process as defined in claim 1 wherein said olefin has the structure $$-\overset{|}{C}=\overset{|}{C}-$$

wherein the valences are satisfied with a member selected from the group consisting of hydrogen, alkyl, aryl, aralkyl, alkaryl, alkenyl and combinations thereof.

4. The process of claim 1 wherein said olefin is provided by an olefinic stream comprising $C_3$ to $C_9$ olefins.

5. The process claimed in claim 1 including the further step of hydrotreating the product of said alkylation.

6. The process of claim 2 wherein said alkylation catalyst is an acid resin.

7. The process of claim 3 wherein said olefin is 1-heptene.

8. The process as claimed in claim 1 wherein said direct liquefaction of coal is at least one process of hydrogenation, destructive distillation, pyrolysis in the absence of hydrogen, or solvent extraction.

9. A process for improving the quality of light fuel oil, derived by the direct liquefaction of coal, said process comprising the steps of:

(i) hydrotreating a light fuel oil liquid; and (ii) contacting the hydrotreated liquid from step (i) with an olefin having at least three carbon atoms under alkylation conditions.

10. The process as defined in claim 9 wherein step (ii) is carried out in the presence of an alkylation catalyst.

11. The process as defined in claim 9 wherein said olefin has the structure $$-\overset{|}{C}=\overset{|}{C}-$$

wherein the valences are satisfied with a member selected from the group consisting of hydrogen, alkyl, aryl, aralkyl, alkaryl, alkenyl and combinations thereof.

12. The process of claim 9 wherein said olefin is provided by an olefinic stream comprising $C_3$ to $C_9$ olefins.

13. The process of claim 9 wherein said hydrotreating in step (i) is carried out at high hydrogen pressure and in the presence of a catalyst.

14. The process of claim 10 wherein said alkylation catalyst is an acid resin.

15. The process of claim 11 wherein said olefin is 1-heptene.

16. The process claimed in claim 9 including the further step of hydrotreating the product of said alkylation.

17. The process as claimed in claim 9 wherein said direct liquefaction of coal is at least one process of hydrogenation, destructive distillation, pyrolysis in the absence of hydrogen, or solvent extraction.

18. A process for improving the cetane index of light fuel oil derived by the direct liquefaction of coal comprising the step of:

(i) contacting said light fuel oil with an olefin, having at least three carbon atoms, in the presence of an alkylation catalyst at a temperature in the range of from about 25° to about 350° C. and at from atmospheric to about 700 psig pressure.

19. The process of claim 18 wherein said alkylation catalyst is an acid resin.

20. The process claimed in claim 18 including the further step of hydrotreating the product of said alkylation.

21. The process as claimed in claim 18 wherein said direct liquefaction of coal is at least one process of hydrogenation, destructive distillation, pyrolysis in the absence of hydrogen, or solvent extraction.

22. A process for improving the cetane index of light fuel oil, derived by the direct liquefaction of coal said process comprising the steps of:

(i) hydrotreating a light fuel oil; and (ii) contacting the hydrotreated liquid from step (i) with an olefin having at least three carbon atoms in the presence of an alkylation catalyst at a temperature in the range of from about 25° to about 350° C. and at from atmospheric to about 700 psig pressure.

23. The process of claim 22 wherein said alkylation catalyst is an acid resin.

24. The process as claimed in claim 22 wherein said direct liquefaction of coal is at least one process of hydrogenation, destructive distillation, pyrolysis in the absence of hydrogen, or solvent extraction.

25. A process for improving the quality of a light fuel oil having a boiling range of about 380° F. to about 700° F. and having a cetane number of about 7 to 10 which light fuel oil was derived by the direct liquefaction of coal which process comprises reacting said light fuel oil with a olefin having at least three carbon atoms at a temperature of about 25° to 350° C. and at a pressure of from about atmospheric to 700 psig in the presence of an acid alkylation catalyst whereby to produce a fuel oil having a cetane number of about 30 to 70.

26. The process as claimed in claim 25 wherein said direct liquefaction of coal is at least one process of hydrogenation, destructive distillation, pyrolysis in the absence of hydrogen, or solvent extraction.

27. The process as claimed in claim 26 wherein said hydrogenation process comprises H-donor solvent reactions.

28. The process as claimed in claim 26 wherein said hydrogenation process comprises pyrolysis in the presence of hydrogen.

* * * * *